US011124924B2

(12) United States Patent
Cai et al.

(10) Patent No.: US 11,124,924 B2
(45) Date of Patent: Sep. 21, 2021

(54) STEEL GIRDER PAVEMENT STRUCTURE FOR HIGH-SPEED ROAD FOR BICYCLE, AND ROADBED PAVEMENT METHOD THEREFOR

(71) Applicant: China Construction Steel Structure Corp. Ltd., Guangdong (CN)

(72) Inventors: Yulong Cai, Guangdong (CN); Changsheng Feng, Guangdong (CN); Zezhen Rong, Guangdong (CN); Weisheng Zheng, Guangdong (CN); Zhiyu Li, Guangdong (CN)

(73) Assignee: CHINA CONSTRUCTION STEEL STRUCTURE CORP. LTD., Guangdong (CN)

( * ) Notice: Subject to any disclaimer, the term of this patent is extended or adjusted under 35 U.S.C. 154(b) by 70 days.

(21) Appl. No.: 16/616,703

(22) PCT Filed: Jul. 3, 2018

(86) PCT No.: PCT/CN2018/094356
§ 371 (c)(1),
(2) Date: Nov. 25, 2019

(87) PCT Pub. No.: WO2018/214985
PCT Pub. Date: Nov. 29, 2018

(65) Prior Publication Data

US 2021/0172126 A1 Jun. 10, 2021

(30) Foreign Application Priority Data

May 24, 2017 (CN) ..... 201710371977.8

(51) Int. Cl.
*E01C 3/00* (2006.01)
*E01C 7/32* (2006.01)
*E01C 11/22* (2006.01)

(52) U.S. Cl.
CPC ..... *E01C 7/325* (2013.01); *E01C 3/00* (2013.01); *E01C 11/226* (2013.01)

(58) Field of Classification Search
CPC ..... E01C 3/00; E01C 7/325; E01C 11/226; E01C 14/17; E01C 14/28–31; E01C 14/72–75
(Continued)

(56) References Cited

U.S. PATENT DOCUMENTS 4,233,356 A * 11/1980 Jacobs ..... E01D 19/083 442/37
4,282,619 A * 8/1981 Rooney ..... E01D 2/04 14/6
(Continued)

FOREIGN PATENT DOCUMENTS

CN 202107961 1/2012
CN 102409587 4/2012
(Continued)

OTHER PUBLICATIONS

International Search Report issued in co-pending application No. PCT/CN2018/094356 dated Aug. 31, 2018.

*Primary Examiner* — Raymond Waddie
(74) *Attorney, Agent, or Firm* — Whiteford, Taylor & Preston, LLP; Peter J. Davis

(57) ABSTRACT

A steel girder pavement structure (100) for high-speed road for bicycle, and a roadbed pavement method therefor. The pavement structure (100) includes a top plate (10), a bottom plate (20), a web (30), stiffening plates (40), and decorative plates (50). A composite roadbed is paved on a surface layer of the top plate (10). The composite roadbed includes, from bottom to top, a substrate, a primer coating and quartz sand (101), a waterproof coating (102), an anti-slip coating and quartz sand (103), a wear-resistant coating (104) and an anti-ultraviolet coating (105). The roadbed pavement
(Continued)

method includes: paving various layers of materials on a surface of the steel plate from bottom to top. The high-speed road for bicycle is easy to seamlessly connect to a transportation hub, and has a high comfort degree.

16 Claims, 3 Drawing Sheets

(58) Field of Classification Search
USPC ..... 404/17–31, 75; 14/73, 74.5, 77.1–78
See application file for complete search history.

(56) References Cited

U.S. PATENT DOCUMENTS 4,362,586 A * 12/1982 Uffner ..... E01C 11/005 14/73
4,625,354 A * 12/1986 Richard ..... E01D 2/04 14/73
4,649,588 A * 3/1987 Taylor ..... E01D 6/00 14/3
5,867,854 A * 2/1999 Matteo ..... E01D 19/125 14/73
6,023,806 A * 2/2000 Dumlao ..... B63B 5/00 14/73
6,217,252 B1 * 4/2001 Tolliver ..... E01F 9/506 404/77
2009/0238811 A1 * 9/2009 McDaniel ..... C09D 5/00 424/94.2
2016/0024723 A1 * 1/2016 Wilson ..... E01C 9/001 404/19
2017/0081807 A1 * 3/2017 Tetrault ..... E01C 13/02
2020/0018134 A1 * 1/2020 Lovoll ..... E21B 41/08
2020/0316824 A1 * 10/2020 Foroni ..... B29C 39/26

FOREIGN PATENT DOCUMENTS

| | | |
|---|---|---|
| CN | 107190604 | 9/2017 |
| CN | 207017100 | 2/2018 |
| JP | 2012188892 | 10/2012 |
| KR | 101124337 | 3/2012 |
| KR | 20150081045 | 7/2015 |

* cited by examiner

STEEL GIRDER PAVEMENT STRUCTURE FOR HIGH-SPEED ROAD FOR BICYCLE, AND ROADBED PAVEMENT METHOD THEREFOR

CROSS-REFERENCE TO RELATED APPLICATIONS

This application claims priority to Chinese Patent Application No. 201710371977.8, titled "STEEL GIRDER PAVEMENT STRUCTURE FOR HIGH-SPEED ROAD FOR BICYCLE, AND ROADBED PAVEMENT METHOD THEREFOR", and filed May 24, 2017, the entire contents of which are incorporated herein by reference.

FIELD

The disclosure belongs to the field of building steel structure technologies, and more particularly, relates to a steel girder pavement structure for high-speed road for a bicycle, configured to erect a high-speed road for bicycle to improve comfortability and riding experience of a cyclist, and realize seamless connection between the bicycle high-speed road and other public transportation hubs, and a roadbed pavement method therefor.

BACKGROUND

With the rapid development of our country's economy, people's living standard is getting higher, and more transportation means are used for traveling, resulting in severer congestion on an urban road. Therefore, how to develop urban road construction is the key to the development of each city. The ultimate goal of urban transportation development is to provide an orderly travel environment for human beings, and with the development of modern urban transportation concepts such as people orientation and green travel, an urban slow traffic system represented by a bicycle high-speed road has gradually received attention.

The bicycle high-speed road refers to urban transportation infrastructure dedicated to bicycle riding, which has the following characteristics: 1) a fast riding speed and a high traffic efficiency: at present, a riding speed of a bicycle is less than 10 km/h due to mixed driving of a motor vehicle and a non-motor vehicle in city, while a designed speed of the bicycle high-speed road can reach 30 km/h, thereby greatly improving a traffic efficiency of the bicycle and indirectly relieving congestion effect in large city; 2) people orientation and fairness: the bicycle high-speed road enables separation of the motor vehicle and the non-motor vehicle, thereby enabling the bicycle to enjoy an independent road right, fully protecting the cyclist from being injured by the motor vehicle, and reducing interaction effect between the two transportation means; and 3) environmental protection, low carbon and health: the bicycle high-speed road advocates green travel, which is of positive significance for improving a living concept of low carbon and environmental protection in modern city and protecting an urban ecological environment.

In foreign countries, with the continuous emergence of transportation problems caused by motorization and the deepening of a concept of sustainable development, the bicycle high-speed road plays an important role in multi-mode integrated transportation. The most representative is the first bicycle high-speed road officially operated in Denmark on Apr. 17, 2012. The bicycle high-speed road with a full length of 22 kilometers connects the downtown of the capital and the suburb of Albers Lang, which uses a special traffic signal system to minimize a waiting time at an intersection.

At present, a bicycle transportation system in domestic city is still at an initial stage, and the planning, design, manufacturing and installation theory and technology are far behind those of developed countries in Europe. An integration scheme on how to plan and build the bicycle high-speed road for large city is of great significance to promote the green, low-carbon and sustainable development of city. However, over the past few decades, urban planning and construction have been excessively pursuing motorized transportation, and gradually compressing or even abolishing roads for the bicycle, but the worsening transportation environment has prompted major cities to speed up the planning of the scheme on a bicycle high-speed road system. The construction of the bicycle high-speed road and the construction of a new transportation system, which is adapted to an urban development stage and seamlessly connected to public transportation, and has green, safe, convenient and efficient features, are important manifestations of strengthening the design of urban low-carbon transformation, encouraging residents to use public transportation and bicycle, and realizing green travel. How to design the bicycle high-speed road to improve comfortability and riding experience of a cyclist and realize seamless connection to urban central areas, large residential areas, public service facilities, commercial office facilities, intersections and other areas has become the top priority in the planning of the bicycle high-speed road.

SUMMARY

At least one technical problem to be solved by the disclosure is to provide a steel girder pavement structure for high-speed road for bicycle, configured to erect a bicycle high-speed road to improve comfortability and riding experience of a cyclist, and realize seamless connection between the bicycle high-speed road and other public transportation hubs to improve an urban road traffic capacity, and to provide a roadbed pavement method therefor.

There is provided in the disclosure a steel girder pavement structure for high-speed road for bicycle, configured to erect a bicycle high-speed road to improve comfortability and riding experience of a cyclist, including: a top plate and a bottom plate arranged opposite to each other in parallel, a plurality of vertical webs and stiffening plates arranged between the top plate and the bottom plate, a plurality of decorative plates respectively arranged at two sides of the top plate and the bottom plate; and a composite roadbed paved on a surface layer of the top plate including, from bottom to top: a substrate, a primer coating and quartz sand paved on the substrate, a waterproof coating paved on the primer coating and quartz sand, an anti-slip coating and quartz sand paved on the waterproof coating, a wear-resistant coating paved on the anti-slip coating, and an anti-ultraviolet coating paved on the wear-resistant coating.

Further, the wear-resistant coating is made of a colored polymer top facing material, and the anti-ultraviolet coating is made by mixing and stirring a transparent colorless material.

Further, the composite roadbed has a thickness greater than or equal to 8 mm.

Further, the top plate above has a length greater than that of the bottom plate, two opposite ends of the plurality of vertical webs are respectively connected to a lower end of the top plate and an upper end of the bottom plate, a part of the stiffening plates have one end arranged at the lower end of the top plate and between adjacent webs and the other end arranged as a free tail end. Another part of the stiffening plates have one end arranged at the upper end of the bottom plate and between adjacent webs and the other end also arranged as a free tail end; and the free tail ends of the stiffening plates arranged on the top plate are opposite to the free tail ends of the stiffening plates arranged on the bottom plate.

Further, the plurality of decorative plates are respectively connected to an end portion of the top plate and an end portion of the bottom plate; and a right triangle structure is formed at one end of the decorative plate connected to the end portion of the top plate, while an outward convex arc structure is formed at one end of the decorative plate connected to the end portion of the bottom plate.

Further, the top plate, the bottom plate, and the plurality of webs and the plurality of stiffening plates connected between the top plate and the bottom plate enclose a main body of the steel girder pavement structure; and the decorative plate, and the web and the stiffening plate connected between the end portion of the top plate and the decorative plate enclose a side end portion of the steel girder pavement structure.

Further, the main body of the steel girder pavement structure has a trapezoidal section.

There is provided in the disclosure a roadbed pavement method for high-speed road for bicycle including the following steps of:

step 1: providing a steel plate and performing substrate surface processing on the steel plate;

step 2: paving a primer coating and quartz sand on the substrate surface, performing flat repair on the substrate surface, and removing redundant quartz sand on the substrate surface;

step 3: paving a grained steel resin waterproof coating on the primer coating and quartz sand, and smoothing and repairing raised portions of a part of the waterproof coating, a welding seam and a welding spot by using mortar;

step 4: paving a grained steel resin anti-slip coating and quartz sand on the waterproof coating, and removing redundant quartz sand on the substrate surface;

step 5: paving a colored composite wear-resistant coating on the anti-slip coating and quartz sand;

step 6: paving an anti-ultraviolet coating on the wear-resistant coating; and step 7: cutting an expansion joint and cleaning sundries in the expansion joint, and then caulking the expansion joint with special caulking glue to be flush with a composite roadbed.

Further, the substrate surface processing in the step 1 above includes washing the top plate with a high-pressure water gun, polishing and cleaning a rust layer or an oil stain on a surface of the top plate completely, dehydrating with a dehydrating strip and drying the top plate.

Further, the polishing and cleaning a rust layer or an oil stain on a surface of the top plate completely further includes cleaning a place with the oil stain through a diluent.

Further, the paving a primer coating and quartz sand in the step 2 includes: covering an edge periphery of the cleaned top plate with a piece of masking paper firstly, evenly stirring adhesive AB in proportion for forming a solvent-free adhesive primer coating and, coating the stirred adhesive AB on the top plate with a cutter in a horizontal and vertical cross rolling manner, evenly spreading 20-mesh quartz sand on the primer coating, and hardening for 6 hours to 8 hours, with a temperature greater than or equal to 15° C.; cleaning redundant quartz sand after the primer coating is hardened, then evenly stirring adhesive AB in proportion for forming a solvent-free adhesive primer coating, evenly coating the stirred adhesive AB on the primer coating with a roller in a horizontal and vertical cross rolling manner, and hardening for 6 hours to 8 hours, with a temperature greater than or equal to 15° C.; and leveling and repairing, in an environment with an atmospheric temperature less than or equal to 70% and a temperature greater than or equal to 5° C., an uneven part by using mortar after the primer coating is completely dried.

Further, the paving a grained steel resin waterproof coating in the step 3 includes: evenly stirring grained steel resin mortar natural color dry powder and an emulsion in proportion, evenly paving the stirred material on the primer coating by using a 5.5 mm aluminum alloy guiding rule, and hardening for at least 8 hours, with a temperature greater than or equal to 15° C.; and smoothing and repairing the raised portions of a part of waterproof coating, the welding seam and the welding spot by using mortar after a mortar layer is dried.

Further, the paving a grained steel resin anti-slip coating and quartz sand in the step 4 includes: stirring a colored grained steel resin material in proportion until no sediment exists at a bottom of a barrel, and evenly paving the stirred material with a 5 mm cutter; and evenly spreading 40-mesh quartz sand on the waterproof coating, and hardening the anti-slip coating for at least 8 hours, with a temperature greater than or equal to 15° C.

Further, the paving a wear-resistant coating in the step 5 includes: evenly coating a colored polymer top facing material on the anti-slip coating and quartz sand with a roller in a horizontal and vertical cross rolling manner.

Further, the paving an anti-ultraviolet coating in the step 6 includes: evenly mixing and stirring a transparent colorless material, and evenly coating the transparent colorless material on the wear-resistant coating with a roller in a horizontal and vertical cross rolling manner.

Further, the step 7 further includes measuring and determining a width of a notch of the expansion joint and an interval between two adjacent expansion joints, and cutting by a cutting machine.

Further, the notch of the expansion joint has a width ranging from 0.4 mm to 0.6 mm, the two adjacent expansion joints have an interval ranging from 6.5 meters to 7 meters, and the expansion joint avoids a position of the welding joint.

Further, the primer coating and quartz sand have a thickness greater than or equal to 0.05 mm, the waterproof coating has a thickness greater than or equal to 1.2 mm, the anti-slip coating and quartz sand have a thickness greater than or equal to 0.05 mm, and the wear-resistant coating has a thickness greater than or equal to 5 mm.

Compared with the prior art, the disclosure has the beneficial effects that: the steel girder pavement structure for high-speed road for bicycle and the roadbed pavement method therefor provided according to the embodiments of the disclosure can not only improve the comfortability and the riding experience of a cyclist, but also realize seamless connection between the bicycle high-speed road and other public transportation hubs by arranging the roadbed paved by various composite materials and the steel girder pavement structure supporting the roadbed, thereby improving the urban road traffic capacity.

BRIEF DESCRIPTION OF THE DRAWINGS

In order to illustrate the technical solutions in the specific embodiments of the disclosure or in the prior art more clearly, the drawings used in the description of the specific embodiments or the prior art will be briefly described below. Obviously, the drawings in the following description are merely some embodiments of the disclosure. Those of ordinary skills in the art can also obtain other drawings according to these drawings without any creative work.

Figure 1:
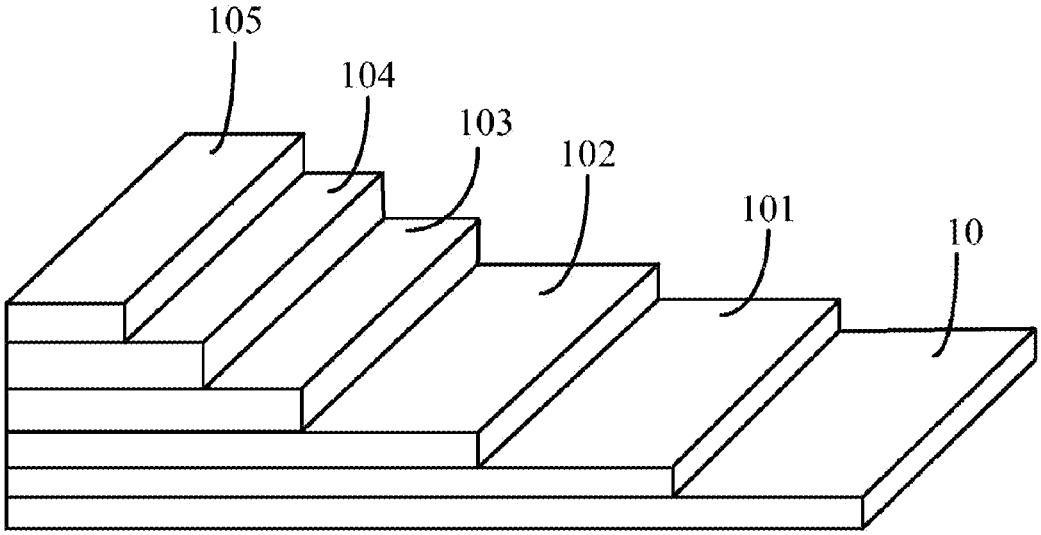
FIG. 1 is a cross section structure diagram of a steel girder pavement structure for a bicycle high-speed road according to an embodiment of the disclosure.

Numerals: 100 refers to steel girder pavement structure; 10 refers to top plate; 20 refers to bottom plate; 30 refers to web; 40 refers to stiffening plate; 50 refers to decorative plate; 101 refers to primer coating and quartz sand; 102 refers to waterproof coating; 103 refers to anti-slip coating and quartz sand; 104 refers to wear-resistant coating; and 105 refers to anti-ultraviolet coating.

DETAILED DESCRIPTION OF THE EMBODIMENTS

The following clearly and completely describes the technical solutions in the embodiments of the disclosure with reference to the accompanying drawings. Apparently, the described embodiments are merely some but not all of the embodiments of the disclosure. Based on the embodiments of the disclosure, all other embodiments obtained by those of ordinary skills in the art without any creative work shall fall within the scope of protection of the disclosure.

In the description of the disclosure, it should be noted that if the orientation or positional relationship indicated by the terms "center", "upper", "lower", "left", "right", "vertical", "horizontal", "inner", "outer" and the like is based on the orientation or positional relationship shown in the drawings, it is only for the convenience of describing the disclosure and simplifying the description, and it is not to indicate or imply that the indicated device or element must have a specific orientation, be constructed and operated in a specific orientation. Therefore, the terms should not be construed as limiting the disclosure. Moreover, the terms "first", "second" and "third" if any are used for descriptive purposes only and cannot be understood as indicating or implying relative importance.

In the description of the disclosure, it should be noted that the terms "installation", "connected" and "connection" if any should be understood in a broad sense unless otherwise specified and defined. For example, they can be fixed connection, removable connection or integrated connection; can be mechanical connection or electrical connection; can be directly connected, can also be indirectly connected through an intermediate medium, and can be connected inside two elements. The specific meaning of the above terms in the disclosure can be understood in a specific case by those of ordinary skills in the art.

Figure 2:
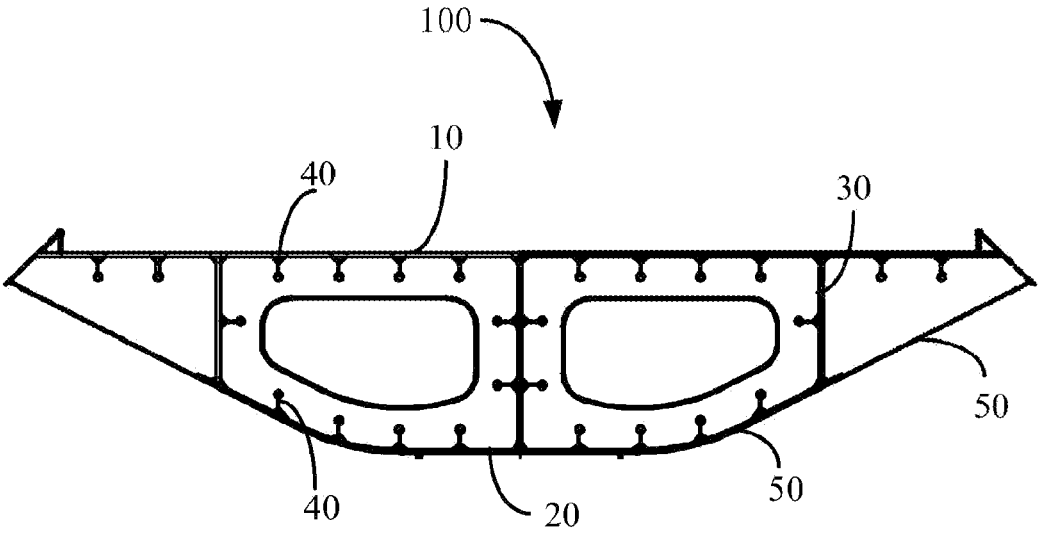
FIG. 2 is a structure diagram of a composite roadbed for the high-speed road with the steel girder pavement structure in FIG. 1.
Figure 3:
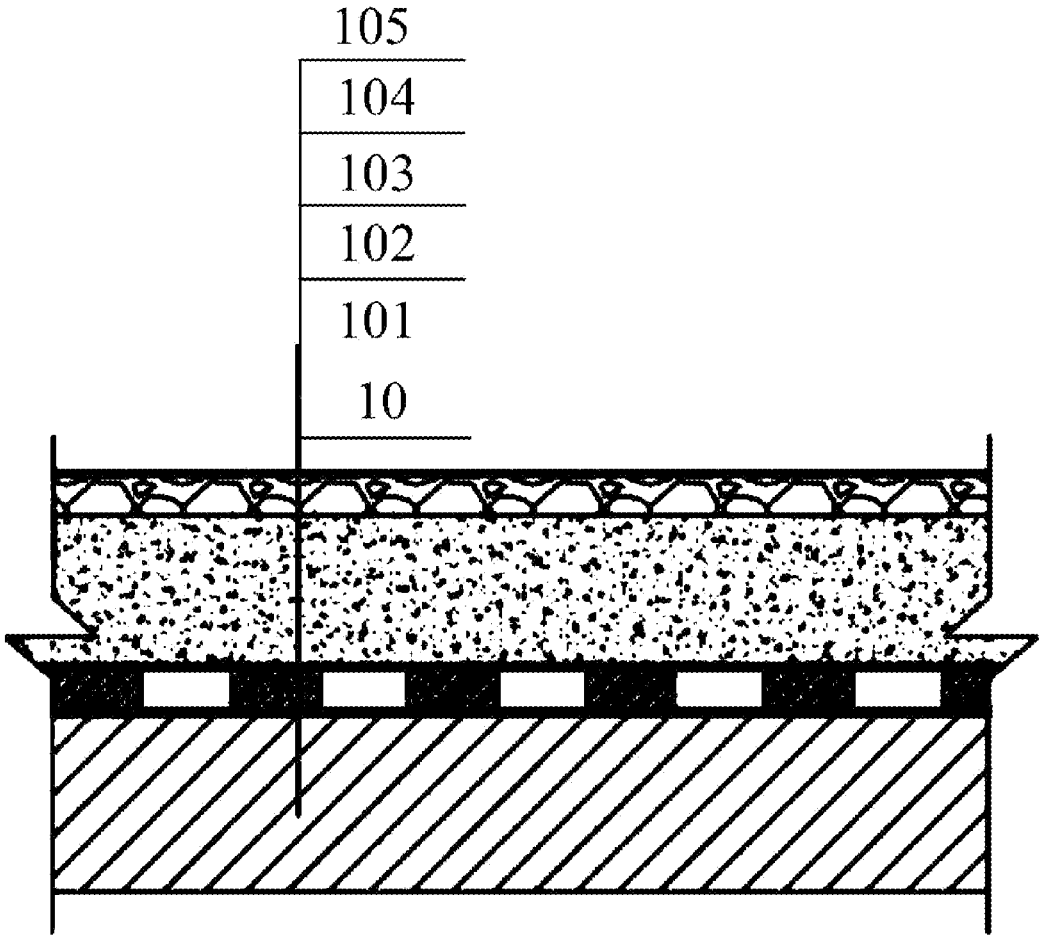
FIG. 3 is a cross section structure diagram of the composite roadbed with the steel girder pavement structure in FIG. 2.

With reference to FIG. 1 to FIG. 3, a steel girder pavement structure 100 for a bicycle high-speed road according to an embodiment of the disclosure is configured to erect a bicycle high-speed road to improve comfortability and riding experience of a cyclist, and the bicycle high-speed road is seamlessly connected to other public transportation hubs (not shown in the drawing) by adopting a supporting steel structure (not shown in the drawing) to adapt to management and traffic of a bicycle road and improve an urban road traffic capacity.

The steel girder pavement structure 100 for a bicycle high-speed road is generally a trapezoidal steel box girder structure, which includes a top plate 10 and a bottom plate 20 arranged opposite to each other in parallel, a plurality of vertical webs 30 and stiffening plates 40 arranged between the top plate 10 and the bottom plate 20, and a plurality of decorative plates 50 respectively arranged at two sides of the top plate 10 and the bottom plate 20. In the embodiment, the top plate 10 has a length greater than that of the bottom plate 20, two opposite ends of the plurality of vertically arranged webs 30 are respectively connected to a lower end of the top plate 10 and an upper end of the bottom plate 20, a part of the stiffening plates 40 have one end arranged at the lower end of the top plate 10 and between adjacent webs 30 and the other end arranged as a free tail end. Another part of the stiffening plates 40 have one end arranged at the upper end of the bottom plate 20 and between adjacent webs 30 and the other end also arranged as a free tail end. The free tail ends of the stiffening plates 40 arranged on the top plate 10 are opposite to the free tail ends of the stiffening plates 40 arranged on the bottom plate 20.

The plurality of decorative plates 50 form a side portion of the steel girder pavement structure 100 and are respectively connected to an end portion of the top plate 10 and an end portion of the bottom plate 20. A right triangle structure is formed at one end of the decorative plate 50 connected to the end portion of the top plate 10, while an outward convex arc structure is formed at one end of the decorative plate 50 connected to the end portion of the bottom plate 20. In the embodiment, the top plate 10, the bottom plate 20, and the plurality of webs 30 and the plurality of stiffening plates 40 connected between the top plate 10 and the bottom plate 20 enclose a main body of the steel girder pavement structure 100; and the decorative plate 50, and the web 30 and the stiffening plate 40 connected between the end portion of the top plate 10 and the decorative plate 50 enclose a side end portion of the steel girder pavement structure 100. The web 30 and the stiffening plate 40 not only greatly enhance an overall strength of the steel girder pavement structure 100, but also enhance a stability of the steel girder pavement structure 100.

A composite roadbed (not indicated by a reference numeral) for the high-speed road with a thickness greater than or equal to 8 mm is paved on a surface layer of the top plate 10 for the cyclist to ride at a high speed.

In the embodiment, the composite roadbed has a thickness of 8 mm, and includes a substrate (not indicated by a reference numeral), a primer coating and quartz sand 101, a waterproof coating 102, an anti-slip coating and quartz sand 103, a wear-resistant coating 104 and an anti-ultraviolet coating 105 from bottom to top. The primer coating and quartz sand 101 are paved on the substrate, the waterproof coating 102 is paved on the primer coating and quartz sand 101, the anti-slip coating and quartz sand 103 are paved on the waterproof coating 102, the wear-resistant coating 104 is paved on the anti-slip coating and quartz sand 103, and the anti-ultraviolet coating 105 is paved on the wear-resistant coating 104.

In the embodiment, before the substrate is paved with a coating, the top plate 10 needs to be washed with a high-pressure water gun firstly, a rust layer on a surface of the top plate 10 is polished and cleaned completely, and then the top plate 10 is dehydrated with a dehydrating strip and dried. In the process, if a rust layer or an oil stain exists on a welding spot of the top plate 10, the rust layer on the surface needs to be completely cleaned, and a place with the oil stain is cleaned with a diluent.

In the paving of the primer coating and quartz sand 101, an edge periphery of the cleaned top plate 10 is covered with a piece of masking paper firstly, adhesive AB for forming a solvent-free adhesive primer coating is evenly stirred in proportion and coated on the top plate 10 with a cutter in a horizontal and vertical cross rolling manner, then 20-mesh quartz sand is evenly spread on the primer, and the primer coating is hardened for 6 hours to 8 hours, with a temperature greater than or equal to 15° C. Redundant quartz sand is cleaned after the primer coating is hardened, then adhesive AB for forming a solvent-free adhesive primer coating is evenly stirred in proportion and evenly coated on a primer coating with a roller in a horizontal and vertical cross rolling manner, and the primer coating is hardened for 6 hours to 8 hours, with a temperature greater than or equal to 15° C. An uneven part is leveled and repaired by using mortar after the primer coating is completely dried. The construction process needs to be performed in an environment with an atmospheric temperature less than or equal to 70% and a temperature greater than or equal to 5° C.

In the paving of the waterproof coating 102, grained steel resin mortar natural color dry powder and an emulsion are evenly stirred in proportion, the stirred material is evenly paved on a primer coating by using a 5.5 mm aluminum alloy guiding rule, and it is hardened for 8 hours, with a temperature greater than or equal to 15° C. The raised portions of a part of waterproof coating, the welding seam and the welding spot are smoothed and repaired by using mortar after a mortar layer is dried.

In the paving of the anti-slip coating and quartz sand 103, a colored grained steel resin material is stirred in proportion until no sediment exists at a bottom of a barrel, and the stirred material is evenly paved with a 5 mm cutter; and 40-mesh special quartz sand is evenly spread on the waterproof coating 102, and a next stage of construction can be performed after cleaning redundant quartz sand after hardening the waterproof coating 102 for 8 hours with a temperature greater than or equal to 15° C.

In the paving of the wear-resistant coating 104, a colored polymer top facing material is evenly coated on the anti-slip coating and quartz sand 103 with a roller in a horizontal and vertical cross rolling manner.

In the paving of the anti-ultraviolet coating 105, a transparent colorless material is evenly mixed and stirred, and evenly coated on the wear-resistant coating 104 with a roller in a horizontal and vertical cross rolling manner.

In the embodiment, the composite roadbed is also provided with an expansion joint. The expansion joint is an expansion device arranged for a ground paving material to expand with heat and contract with cold. The installation quality of the expansion joint directly affects safety and comfortability when riding on the roadbed and is an important control part of roadbed construction. After the ground construction is completed, a width of a notch of the expansion joint is accurately measured firstly (0.5 mm), and then cutting is performed with a cutting machine (with an interval ranging from 6.5 meters to 7 meters, avoiding the welding seam); and after the cutting is completed, sundries in the expansion joint are cleaned, and after the sundries are cleaned, the expansion joint is caulked with special caulking glue to enable a height of the expansion joint to be flush with the composite roadbed.

The primer coating and quartz sand have a thickness greater than or equal to 0.05 mm, the waterproof coating has a thickness greater than or equal to 1.2 mm, the anti-slip coating and quartz sand have a thickness greater than or equal to 0.05 mm, and the wear-resistant coating has a thickness greater than or equal to 5 mm.

In the embodiment, the primer coating and quartz sand 101 have the thickness of 0.05 mm, the waterproof coating 102 has the thickness of 1.2 mm, the anti-slip coating and quartz sand 103 have the thickness of 0.05 mm, and the wear-resistant coating 104 has the thickness of 5 mm.

Figure 4:
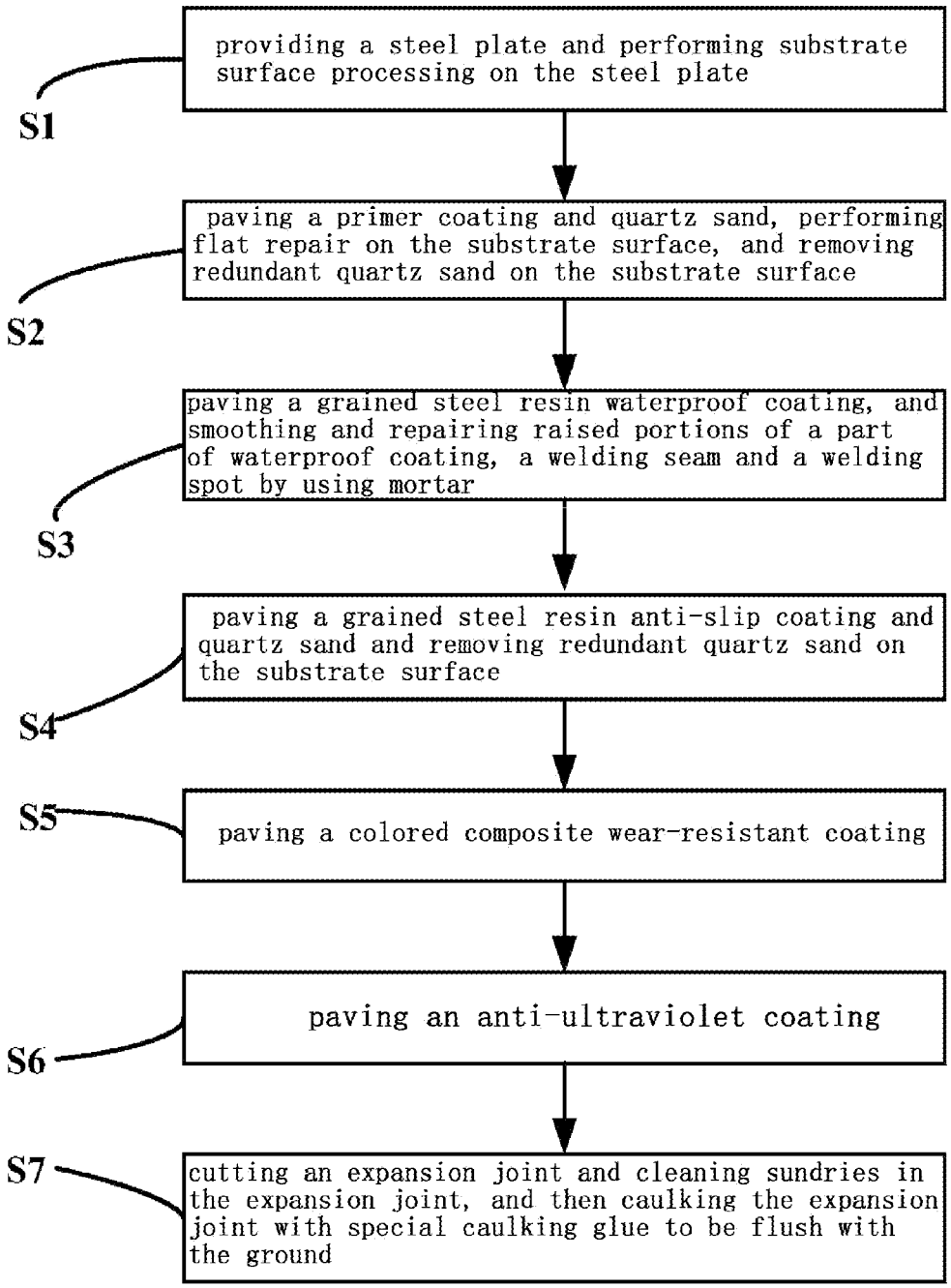
FIG. 4 is a flow chart of a roadbed pavement method for a bicycle high-speed road according to an embodiment of the disclosure.

FIG. 4 is a flow chart of a roadbed pavement method for a bicycle high-speed road according to an embodiment of the disclosure, and the roadbed pavement method for a bicycle high-speed road includes the following steps of:

step 1: providing a steel plate and performing substrate surface processing on the steel plate;

step 2: paving a primer coating and quartz sand 101 on the substrate surface, performing flat repair on the substrate surface, and removing redundant quartz sand on the substrate surface;

step 3: paving a grained steel resin waterproof coating 102 on the primer coating and quartz sand 101, and smoothing and repairing raised portions of a part of waterproof coating 102, a welding seam and a welding spot by using mortar;

step 4: paving a grained steel resin anti-slip coating and quartz sand 103 on the waterproof coating 102, and removing redundant quartz sand on the substrate surface;

step 5: paving a colored composite wear-resistant coating 104 on the anti-slip coating and quartz sand 103;

step 6: paving an anti-ultraviolet coating 105 on the wear-resistant coating 104; and step 7: cutting an expansion joint and cleaning sundries in the expansion joint, and then caulking the expansion joint with special caulking glue to be flush with the composite roadbed.

In the step S1, the top plate 10 needs to be washed with a high-pressure water gun firstly, a rust layer on a surface of the top plate 10 is polished and cleaned completely, and the top plate 10 is dehydrated with a dehydrating strip and dried. In the process, if a rust layer or an oil stain exists on a welding spot of the top plate 10, the rust layer on the surface needs to be completely cleaned, and a place with the oil stain is cleaned with a diluent.

In the step S2, an edge periphery of the cleaned top plate is covered with a piece of masking paper firstly, adhesive AB for forming a solvent-free adhesive primer coating is evenly stirred in proportion and coated on the top plate 10 with a cutter in a horizontal and vertical cross rolling manner, then 20-mesh quartz sand is evenly spread on the primer coating, and the primer coating is hardened for 6 hours to 8 hours, with a temperature greater than or equal to 15° C. Redundant quartz sand is cleaned after the primer coating is hardened, then adhesive AB for forming a solvent-free adhesive primer coating is evenly stirred in proportion and evenly coated on the primer coating with a roller in a horizontal and vertical cross rolling manner, and the primer coating is hardened for 6 hours to 8 hours, with a temperature greater than or equal to 15° C. An uneven part is leveled and repaired by using mortar after the primer coating is completely dried. The construction process needs to be performed in an environment with an atmospheric temperature less than or equal to 70% and a temperature greater than or equal to 5° C.

In the step S3, grained steel resin mortar natural color dry powder and an emulsion are evenly stirred in proportion, the stirred material is evenly paved on the primer coating by using a 5.5 mm aluminum alloy guiding rule, and the primer coating is hardened for at least 8 hours. Preferably, in order to save a construction time, it is hardened for 8 hours, with a temperature greater than or equal to 15° C. The raised portions of a part of waterproof coating, the welding seam and the welding spot are smoothed and repaired by using mortar after a mortar layer is dried.

In the step S4, a colored grained steel resin material is stirred in proportion until no sediment exists at a bottom of a barrel, and the stirred material is evenly paved with a 5 mm cutter; and 40-mesh special quartz sand is evenly spread on the waterproof coating 102, and a next stage of construction can be performed after cleaning redundant quartz sand after hardening the waterproof coating 102 for at least 8 hours. Preferably, in order to save a construction time, the waterproof coating 102 is hardened for 8 hours with a temperature greater than or equal to 15° C.

In the step S5, a colored polymer top facing material is evenly coated on the anti-slip coating and quartz sand 103 with a roller in a horizontal and vertical cross rolling manner.

In the step S6, a transparent colorless material is evenly mixed and stirred, and evenly coated on the wear-resistant coating 104 with a roller in a horizontal and vertical cross rolling manner.

In the step S7, after the ground construction is completed, a width of a notch of the expansion joint is accurately measured firstly (the width of the notch of the expansion joint ranges from 0.4 mm to 0.6 mm, and preferably, the width of the notch of the expansion joint is 0.5 mm), and then cutting is performed with a cutting machine (with an interval ranging from 6.5 meters to 7 meters, avoiding the welding seam); and after the cutting is completed, sundries in the expansion joint are cleaned, and after the sundries are cleaned, the expansion joint is caulked with special caulking glue to enable a height of the expansion joint to be flush with the composite roadbed.

The steel girder pavement structure for high-speed road for bicycle and the roadbed pavement method therefor according to the embodiments of the disclosure can not only improve the comfortability and the riding experience of a cyclist, but also realize seamless connection between the bicycle high-speed road and other public transportation hubs by arranging the roadbed paved by various composite materials and the steel girder pavement structure for the bicycle high-speed road supporting the roadbed, thereby improving the urban road traffic capacity.

The description above is merely preferred embodiments of the disclosure and is not configured to limit the disclosure, and various modifications and changes can be made to the disclosure for those skilled in the art. All the modifications, equivalents, and improvements made within the concept and principle of the disclosure shall be included within the protection scope of the disclosure.

INDUSTRIAL APPLICABILITY

The steel girder pavement structure for the bicycle high-speed road and the roadbed pavement method therefor provided according to the embodiments of the disclosure can not only improve the comfortability and riding experience of a cyclist, but also realize seamless connection between a bicycle high-speed road and other public transportation hubs, thereby improving an urban road traffic capacity.

The invention claimed is:

1. A steel girder pavement structure for high-speed road for bicycle, configured to erect a bicycle high-speed road to seamlessly connect to other public transportation hubs, comprising:

a top plate and a bottom plate arranged opposite to each other in parallel, a plurality of vertical webs and stiffening plates arranged between the top plate and the bottom plate, a plurality of decorative plates respectively arranged at two sides of the top plate and the bottom plate; and a composite roadbed paved on a surface layer of the top plate comprising, from bottom to top:

a substrate, a primer coating and quartz sand paved on the substrate, a waterproof coating paved on the primer coating and quartz sand, an anti-slip coating and quartz sand paved on the waterproof coating, a wear-resistant coating paved on the anti-slip coating, and an anti-ultraviolet coating paved on the wear-resistant coating;

wherein the top plate has a length greater than that of the bottom plate, two opposite ends of the plurality of vertical webs are respectively connected to a lower end of the top plate and an upper end of the bottom plate, a part of the stiffening plates have one end arranged at the lower end of the top plate and between adjacent webs and the other end arranged as a free tail end; another part of the stiffening plates have one end arranged at the upper end of the bottom plate and between adjacent webs and the other end also arranged as a free tail end; and the free tail ends of the stiffening plates arranged on the top plate are opposite to the free tail ends of the stiffening plates arranged on the bottom plate; and the plurality of decorative plates are respectively connected to an end portion of the top plate and an end portion of the bottom plate; and a right triangle structure is formed at one end of the decorative plate connected to the end portion of the top plate, while an outward convex arc structure is formed at one end of the decorative plate connected to the end portion of the bottom plate.

2. The steel girder pavement structure of claim 1, wherein the wear-resistant coating is made of a colored polymer top facing material, and the anti-ultraviolet coating is made by mixing and stirring a transparent colorless material.

3. The steel girder pavement structure of claim 1, wherein the composite roadbed has a thickness greater than or equal to 8 mm.

4. The steel girder pavement structure of claim 1, wherein the top plate, the bottom plate, and the plurality of webs and the plurality of stiffening plates connected between the top plate and the bottom plate enclose a main body of the steel girder pavement structure; and the decorative plate, and the web and the stiffening plate connected between the end portion of the top plate and the decorative plate enclose a side end portion of the steel girder pavement structure.

5. The steel girder pavement structure of claim 4, wherein the main body of the steel girder pavement structure has a trapezoidal section.

6. A roadbed pavement method for high-speed road for bicycle, comprising the following steps of:

step 1: providing a steel plate and performing substrate surface processing on the steel plate;

step 2: paving a primer coating and quartz sand on the substrate surface, performing flat repair on the substrate surface, and removing redundant quartz sand on the substrate surface;

step 3: paving a grained steel resin waterproof coating on the primer coating and quartz sand, and smoothing and repairing raised portions of a part of waterproof coating, a welding seam and a welding spot by using mortar;

step 4: paving a grained steel resin anti-slip coating and quartz sand on the waterproof coating, and removing redundant quartz sand on the substrate surface;

step 5: paving a colored composite wear-resistant coating on the anti-slip coating and quartz sand;

step 6: paving an anti-ultraviolet coating on the wear-resistant coating; and step 7: cutting an expansion joint and cleaning sundries in the expansion joint, and then caulking the expansion joint with special caulking glue to be flush with the composite roadbed.

7. The roadbed pavement method of claim 6, wherein the substrate surface processing in the step 1 comprises:

washing the top plate with a high-pressure water gun, polishing and cleaning a rust layer or an oil stain on a surface of the top plate completely, dehydrating with a dehydrating strip and drying the top plate.

8. The roadbed pavement method of claim 7, wherein the polishing and cleaning a rust layer or an oil stain on a surface of the top plate completely further comprises cleaning a place with the oil stain through a diluent.

9. The roadbed pavement method of claim 6, wherein the paving a primer coating and quartz sand in the step 2 comprises:

covering an edge periphery of the cleaned top plate with a piece of masking paper firstly, evenly stirring adhesive AB in proportion for forming a solvent-free adhesive primer coating and, coating the stirred adhesive AB on the top plate with a cutter in a horizontal and vertical cross rolling manner, evenly spreading 20-mesh quartz sand on the primer coating, and hardening for 6 hours to 8 hours, with a temperature greater than or equal to 15° C.;

cleaning redundant quartz sand after the primer coating is hardened, then evenly stirring adhesive AB in proportion for forming a solvent-free adhesive primer coating, evenly coating the stirred adhesive AB on the primer coating with a roller in a horizontal and vertical cross rolling manner, and hardening for 6 hours to 8 hours, with a temperature greater than or equal to 15° C.; and leveling and repairing, in an environment with an atmospheric temperature less than or equal to 70% and a temperature greater than or equal to 5° C., an uneven part by using mortar after the primer coating is completely dried.

10. The roadbed pavement method of claim 6, wherein the paving a grained steel resin waterproof coating in the step 3 comprises:

evenly stirring grained steel resin mortar natural color dry powder and an emulsion in proportion, evenly paving the stirred material on the primer coating by using a 5.5 mm aluminum alloy guiding rule, and hardening for at least 8 hours, with a temperature greater than or equal to 15° C.; and smoothing and repairing the raised portions of a part of the waterproof coating, the welding seam and the welding spot by using mortar after a mortar layer is dried.

11. The roadbed pavement method of claim 6, wherein the paving a grained steel resin anti-slip coating and quartz sand in the step 4 comprises:

stirring a colored grained steel resin material in proportion until no sediment exists at a bottom of a barrel, and evenly paving the stirred material with a 5 mm cutter; and evenly spreading 40-mesh quartz sand on the waterproof coating, and hardening the anti-slip coating for at least 8 hours, with a temperature greater than or equal to 15° C.

12. The roadbed pavement method of claim 6, wherein the paving a wear-resistant coating in the step 5 comprises:

evenly coating a colored polymer top facing material on the anti-slip coating and quartz sand with a roller in a horizontal and vertical cross rolling manner.

13. The roadbed pavement method of claim 6, wherein the paving an anti-ultraviolet coating in the step 6 comprises:

evenly mixing and stirring a transparent colorless material, and evenly coating the transparent colorless material on the wear-resistant coating with a roller in a horizontal and vertical cross rolling manner.

14. The roadbed pavement method of claim 6, wherein the primer coating and quartz sand have a thickness greater than or equal to 0.05 mm, the waterproof coating has a thickness greater than or equal to 1.2 mm, the anti-slip coating and quartz sand have a thickness greater than or equal to 0.05 mm, and the wear-resistant coating has a thickness greater than or equal to 5 mm.

15. The roadbed pavement method of claim 6, wherein the step 7 further comprises: measuring and determining a width of a notch of the expansion joint and an interval between two adjacent expansion joints, and cutting by a cutting machine.

16. The roadbed pavement method of claim 15, wherein the notch of the expansion joint has a width ranging from 0.4 mm to 0.6 mm, the two adjacent expansion joints have an interval ranging from 6.5 meters to 7 meters, and the expansion joint avoids a position of the welding joint.

* * * * *